United States Patent [19]

Walton

[11] Patent Number: 5,022,099

[45] Date of Patent: Jun. 11, 1991

[54] RADIATION HELMET

[76] Inventor: Charles A. Walton, 19115 Overlook Rd., Los Gatos, Calif. 95030

[21] Appl. No.: 474,450

[22] Filed: Feb. 2, 1990

[51] Int. Cl.[5] ..... A42B 1/06

[52] U.S. Cl. ..... 2/410; 2/63; 2/2; 128/857; 250/516.1

[58] Field of Search ..... 2/2, 410, 417, 6, 63; 250/516.1; 128/379, 380, 857

[56] References Cited

U.S. PATENT DOCUMENTS

| | | | |
|---|---|---|---|
| 1,906,990 | 5/1933 | McGill | 2/63 |
| 2,478,550 | 8/1949 | Smith | 2/63 |
| 2,855,603 | 10/1958 | Zito | 2/2 |
| 3,086,211 | 4/1963 | De Grazia | 2/2 |
| 3,123,831 | 3/1964 | Wells et al. | 250/516.1 |
| 3,164,840 | 1/1965 | Reynolds | 250/516.1 |
| 3,465,153 | 9/1969 | Libby | 2/2 |
| 3,780,379 | 12/1973 | Kampman | 2/2 |
| 4,286,170 | 8/1981 | Moti | 250/516.1 |
| 4,386,277 | 5/1983 | Forshee | 250/516.1 |

FOREIGN PATENT DOCUMENTS

| | | | |
|---|---|---|---|
| 353685 | 6/1931 | United Kingdom | 2/63 |

*Primary Examiner*—Werner H. Schroeder
*Assistant Examiner*—Michael A. Neas
*Attorney, Agent, or Firm*—Thomas E. Schatzel

[57] ABSTRACT

An improved radiation helmet having a radiation opaque liner and a replaceable hygienic tissue that is worn over the head of a dental patient during X-rays to protect the head from stray radiation. An alternative construction is to use radiation opaque materials for the radiation helmet and to omit the liner.

4 Claims, 1 Drawing Sheet

RADIATION HELMET

BACKGROUND OF THE INVENTION

1. Field of the Invention

The invention relates generally to radiation protection and more particularly to apparel worn to protect the head from X-radiation.

2. Description of the Prior Art

Dental offices usually provide extreme protection for the dentist or other operator of dental X-ray equipment, such as the operator's removal to another room behind a lead wall. The dental patient is often protected from exposure to X-rays of some parts of the body. A lead apron is draped over the torso, especially of women who are pregnant or who are suspected of being pregnant. Protection from X-rays for the heads of patients is universally absent.

Recent government studies now indicate that no amount of radiation exposure is completely safe. It had been the opinion of many that negligible and insignificant levels or accumulated doses of radiation posed no health risks at all. The radiation helmet offers a degree of protection to the head of the patient that reduces the ill effects caused by even low levels of radiation exposure.

SUMMARY OF THE PRESENT INVENTION

It is therefore an object of the present invention to provide a radiation helmet for protection of the wearer's head from even low levels of radiation exposure.

It is a further object to provide an improved radiation helmet that is not bulky or awkward.

It is a further object to provide an improved radiation helmet that may be hygienically worn by successive wearers.

Briefly, a preferred embodiment includes a helmet, shaped to fit over the head of a typical dental patient, a liner, and a replaceable hygienic tissue. The helmet holds in place both the liner and the hygienic tissue. The liner is constructed of radiation opaque materials, one example of a material being lead.

A second preferred embodiment is similar to U the first, but the radiation opaque materials of the liner are instead incorporated into the materials of the helmet itself.

An advantage of the present invention is that the wearer of the helmet has less radiation exposure to his or her head.

Another advantage of the present invention is the helmet reduces accumulated radiation dosage levels when it is worn each time a particular wearer has dental X-rays taken.

Another advantage of the present invention is the wearer will suffer no or lesser health consequences of having had his or her dental X-rays taken.

These and other objects and advantages of the present invention will no doubt become obvious to those of ordinary skill in the art after having read the following detailed description of the preferred embodiment(s) which are illustrated in the various drawing figures.

IN THE DRAWINGS

DETAILED DESCRIPTION OF THE PREFERRED EMBODIMENT

Figure 1:
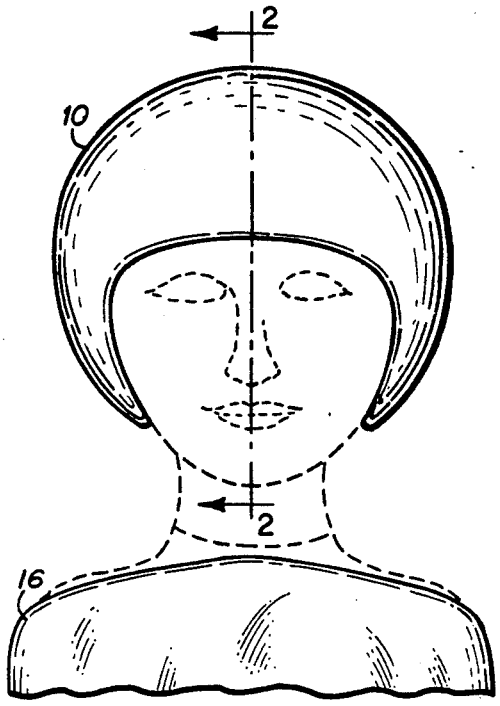
FIG. 1 is a front elevational view of a radiation helmet and its wearer in accordance with the present invention.
Figure 2:
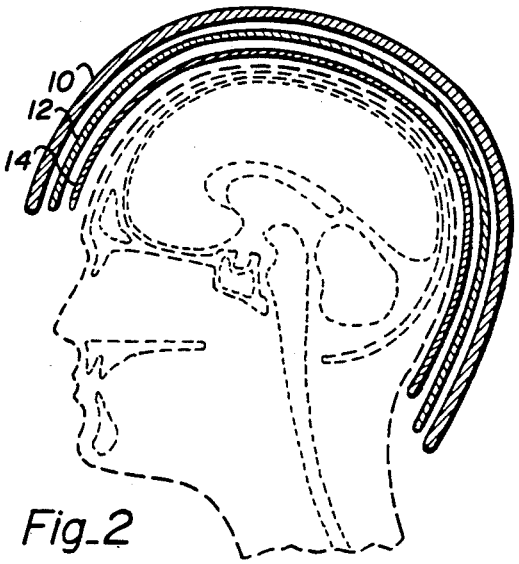
FIG. 2 is a cross-sectional view of the radiation helmet and its wearer in accordance with the present invention taken along the line 2—2 of FIG. 1.
Figure 3:
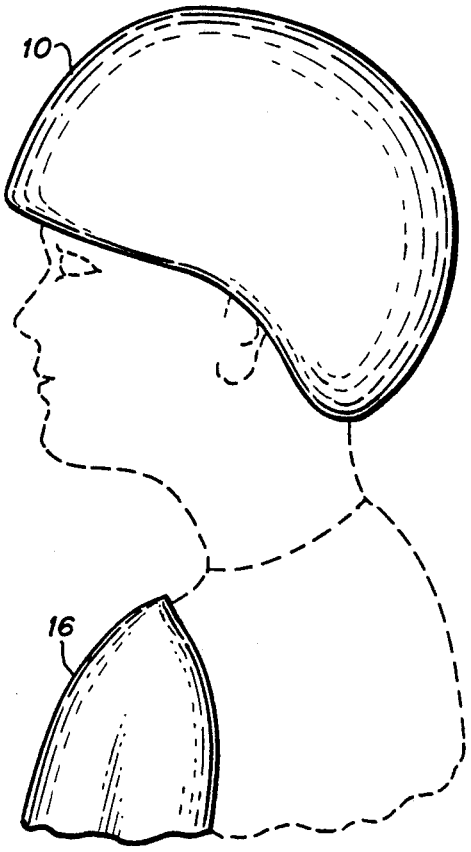
FIG. 3 is a side elevational view of a radiation helmet and its wearer in accordance with the present invention.

Referring now to FIG. 1-3., there is shown a radiation helmet referred to by the general reference numeral 10 containing the invention shaped to fit over the head of its wearer. The radiation helmet 10 includes a liner 12 and a replaceable hygienic tissue 14. A leaded apron 16 which is not part of the present invention is shown also being worn by the wearer. The liner 12 is held in place within the radiation helmet 10 by press fitting of one inside the other, or by other suitable means, including but not limited to, adhesives and fasteners. The replaceable hygienic tissue 14 is attached to the inside of the liner 12 by means including, but not limited to, adhesives and fasteners.

With the helmet 10, radiation exposure to the head of the wearer is substantially inhibited by operation of the radiation opaque materials of the liner 12. The protection is similar to that afforded by the leaded apron 16. Hygiene of the wearers of the radiation helmet 10 is maintained by the tearing off of a used replaceable hygienic tissue 14, thus exposing a fresh one, or the replacement of the used one with a fresh one. The advantages become more apparent when the invention is used as a patient's protection which is worn during dental X-rays of the patient.

Figure 4:
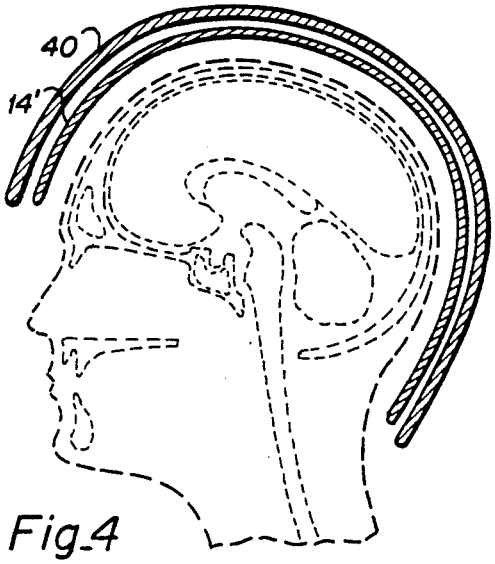
FIG. 4 is a cross-sectional view of an alternative embodiment of the radiation helmet and its wearer in accordance with the present invention and is similar to FIG. 2.

A second preferred embodiment is shown in FIG. 4 and referred to by the general reference numeral 40. Components of helmet 40 similar to components of helmet 10 carry the same reference numerals distinguished by a prime designation. The major difference is that liner 12 is omitted in helmet 40. The radiation helmet 40 is constructed of radiation opaque materials. The outside appearance of helmets 10 and 40 are the same.

With the radiation helmet 40, radiation exposure to the head of the wearer is substantially inhibited by operation of the radiation opaque materials of the radiation helmet. The protection is similar to that afforded by the leaded apron 16 shown in FIGS. 1 and 3. Hygiene of the wearers of the radiation helmet 40 is maintained by the tearing off of a used replaceable hygienic tissue 14', thus exposing a fresh one, or the replacement of the used one with a fresh one. The advantages become more apparent when the invention is used as a patient's protection which is worn during dental X-rays of the patient.

Figure 5:
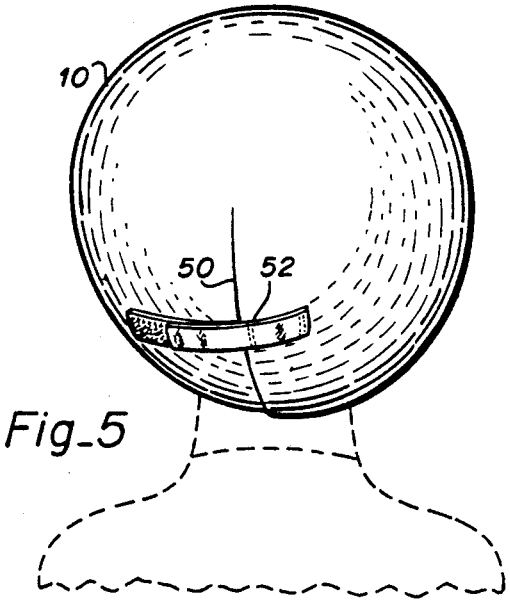
FIG. 5 is an elevational view of the rear of the radiation helmet and its wearer in accordance with the present invention.

Shown in FIG. 5 are a means for loosening and tightening the helmet that allow for variations in patient's head sizes and hairdos. A convenient means of adjustment is to allow an overlap 50 in the back of helmet 10 or 40, with a Velcro® strap 52 to pull and secure the flaps together.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A radiation helmet for wearing by a dental patient comprising, in combination:

a helmet for wearing about the head of an individual and shaped to allow exposure of said wearer's jaw area and an X-ray of the wearer's teeth; and a liner constructed of X-ray opaque material positioned within the helmet to protect said wearer's head covered by the liner from X-ray radiation;

whereby external X-ray radiation is inhibited from reaching the head and internal organs of the head of a wearer while permitting X-ray pictures of said wearer's jaw area and teeth.

2. The helmet of claim 1 further including, a replaceable hygienic tissue positioned within the helmet and over the liner to separate said wearer's head from the liner surface.

3. A radiation helmet for wearing by a dental patient comprising, in combination:

a helmet for wearing about the head of an individual and constructed of X-ray opaque material, the helmet being shaped to allow exposure of said wearer's jaw area and an X-ray of the wearer's teeth;

whereby external X-ray radiation is inhibited from reaching the head and internal organs of a wearer while permitting X-ray pictures of said wearer's jaw area and teeth.

4. The helmet of claim 3 further including, a replaceable hygienic tissue positioned within the helmet and over the liner to separate said wearer's head from the liner surface.

* * * * *